United States Patent [19]

Geiger

[11] 4,456,140

[45] Jun. 26, 1984

[54] PLUGGING DEVICE FOR A BOTTLE, NOTABLY A SCENT BOTTLE

[76] Inventor: Reinold Geiger, 38, rue de Longchamp, 92200 Neuilly sur Seine, France

[21] Appl. No.: 396,821

[22] Filed: Jul. 9, 1982

[30] Foreign Application Priority Data

Jul. 10, 1981 [FR] France ..... 81 13694

[51] Int. Cl.[3] ..... B65D 39/00

[52] U.S. Cl. ..... 215/364

[58] Field of Search ..... 215/364, 354, 320

[56] References Cited

U.S. PATENT DOCUMENTS 1,098,051 5/1914 Pick ..... 215/364

2,192,511 3/1940 Thomas ..... 215/364

FOREIGN PATENT DOCUMENTS 431109 2/1948 Italy ..... 215/364

*Primary Examiner*—Donald F. Norton

*Attorney, Agent, or Firm*—Sandler & Greenblum

[57] ABSTRACT

A plugging device for bottles such as a scent bottle, includes a plug and a plunger. The plug has a bottom portion and a rib on the bottom portion with an edge. The plunger includes a body, a base wider than the body, and a shoulder connecting the base to the body. The plunger is adapted to mate with an opening in the neck of the bottle and is also adapted to be rigidly connected to the plug bottom. The plunger is made of a material different from that of the plug bottom. The base of the plunger is adapted to cooperate with the rib of the plug so as to rigidly connect the plunger to the plug. This is accomplished by applying heat to the rib and then folding the edge of the rib back against the shoulder so that this folded edge acts as an abutment for firmly holding the plunger in the plug. The rib may be composed of a thermo-meltable material.

27 Claims, 13 Drawing Figures

PLUGGING DEVICE FOR A BOTTLE, NOTABLY A SCENT BOTTLE

FIELD OF THE INVENTION

Description of the Prior Art

The invention relates to a plugging device for a bottle, notably a scent bottle.

The plugging of a bottle, notably a scent bottle, poses a number of problems which until now have not been satisfactorily solved.

To be effective, the plugging of the bottle must be tight, expecially when the liquid kept in the bottle is highly volatile.

In addition, the plugging device should be adapted for low cost production.

Finally the plugging device must be safe, that is the devices manufactured must exhibit the required plugging qualities.

It has been proposed to plug a bottle by driving, into a duct of the neck, an elongated body or finger or plunger which is part of the plug. At least one of the surfaces of the finger cooperates with the plugging and is preferably frustoconical.

It is known that an efficient plugging is only obtained if the plunger is of a predetermined material (or family of materials). If the plug body is made of such predetermined materials, the plug and plunger assembly can be formed integrally, preferably by molding, which is the usual method of forming such devices.

Should it not be possible to use such materials that can be easily molded, which is frequently the case because the plug body, in the field of perfumery, must comply with considerations of an aesthetic nature which cannot be satisfied easily by molded materials forming the plunger, then a problem arises as to how to assemble the plunger with the plug body.

In order to solve this problem, the prior art has proposed providing the bottom of the plug body with a housing or shaft bounded by a rib, and forcibly driving the plunger via its base into the housing. But it has been found that it is not possible to always obtain assembly of the plug body and the plunger with assurance and that, in a mass production, some plugging devices were faulty.

Moreover, when it is necessary to product a plug which requires a large traction to be applied to the plug in order to separate it from the bottle, the friction resisting the pulling of the plug out of the plunger the above described assembly sometimes proves insufficiently resistant.

SUMMARY OF THE INVENTION

It is an object of the present invention to remedy such disadvantages. The device which achieves this objective is a bottle plugging device, notably for a scent bottle, in which the plug comprises a finger or plunger, adapted to cooperate with an opening in the neck of the bottle for plugging the bottle and, maintained in the bottleneck by a rib projecting from the bottom of the plug. The plunger includes a base of cross section larger than the plunger body. The base is conjugated to the housing or shaft bounded by the rib. The device is assembled by folding back the rib portion protruding relative to the base when the latter is applied against the bottom of the plug body. The folding back is carried out against a shoulder formed by said base with the plunger body and the folded back portion thus provides an abutment for the base preventing the separation of the plunger from the plug body.

In one embodiment, the rib has the configuration of a complete circumference of a circle.

In another embodiment, the rib is formed by arcs of the same circumference, preferably two arcs, each of which covers a little less than half the circumference of a complete circle.

BRIEF DESCRIPTION OF DRAWINGS

In the following description which is given by way of example, reference is made to the accompanying drawings wherein.

DETAILED DESCRIPTION OF EMBODIMENTS

Figure 1:
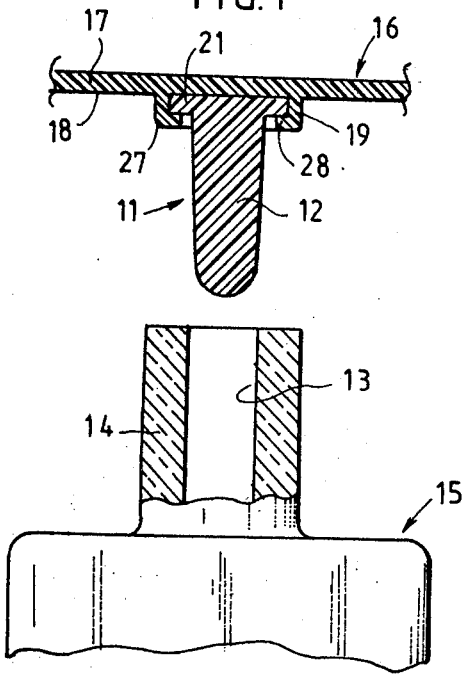
FIG. 1 is an elevation view, with a portion in section, of a device according to the invention.
Figure 2:
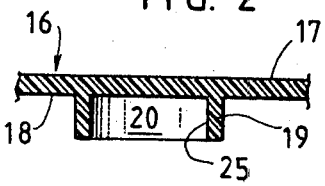
FIG. 2 is a sectional view of a plug portion before assembly of the plunger.
Figure 3:
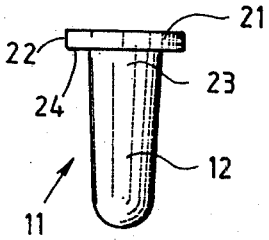
FIG. 3 is an elevation view of the plunger.

The plunger 11 of plug 16 is made of polypropylene, which is a material that permits obtaining a tight fit on bottle 15 by cooperation between its frustoconical body 12 and an opening or duct 13 formed in the neck 14 of a bottle 15 which is to be closed. Plug 16 is made of a material different from polypropylene, chosen by example for considerations of an aesthetic nature. A rib is formed on bottom 17 of plug 16 which, protrudes from inner face 18 of bottom 17. Rib 19 has a circular configuration, and is thin and, made of a thermo-meltable material. This material can be, for example, the same material that forms the bottom 17 of the plug and/or its body 12, such as nylon, cellulose acetate, etc.

Body 12 of plunger 11 also comprises a base 21 with cylindrical circular outer surface 22 of a larger diameter that of the top portion 23 of plunger body 12, which is fixed to base 21, so as to form an annular shoulder 24.

The diameter of cylindrical surface 22 and that of the inner surface 25 of rib 19 are such that base 21 can be introduced without difficulty into the housing or shaft 20 bounded by rib 19. The height of rib 19 is slightly greater than that of base 21.

To assemble the device, a portion 27 of the rib, which protrudes relative to base 21 is folded back on shoulder 24 of base 21. This folding back of portion 27 is carried out by applying heat when rib 19 is composed of a thermo-meltable material. This heat is preferably produced by, an ultrasound tool. After cooling, which is almost immediate, the edge 28 of the rib forms an abutment which cooperates with the shoulder 24 of base 21, thereby positively securing the plunger 11 against motion relative to the body of plug 16. An integral connection is thereby obtained which is better than that resulting hitherto from a force fitting of plug 16 and plunger 11.

Figure 4:
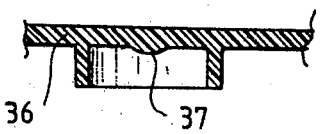
FIG. 4 is a sectional view similar to FIG. 2, with a slight alteration.
Figure 5:
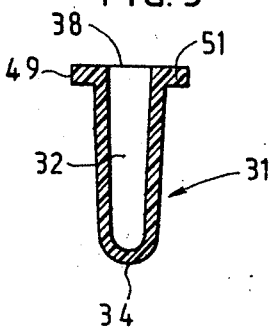
FIG. 5 is an axial sectional view of a plunger.

In the embodiment shown in FIG. 5, the frustoconical body 31, of the plunger, is tubular, having a central cavity 32. The bottom 36 of the plug (FIG. 4) can be formed with a slight bulging 37 which is in register with and adopted to be received in the end 38 of the channel 32 opposite apex 34.

Figure 6:
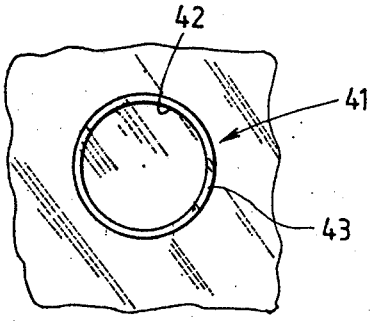
FIG. 6 is a front view of a portion of the bottom of a plug showing a rib.

In a embodiment shown in FIG. 6, the rib 41 on the bottom of the plug has a closed circular configuration bounded by a cylindrical inner surface 42 and a cylindrical outer surface 43.

Figure 7:
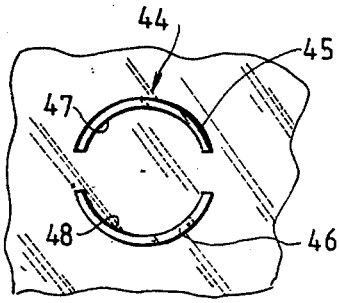
FIG. 7 is a front view similar to FIG. 6, but of another embodiment.

In the embodiment shown in FIG. 7, the rib 44 on the bottom of the plug comprises two half ribs 45 and 46, each of which covers a little less than half a circumference of a circle. The inner surfaces 47 and 48 of the two half ribs are adopted to mates with the outer surface 22 or 49 of the plunger base 21 or 51.

Figure 8:
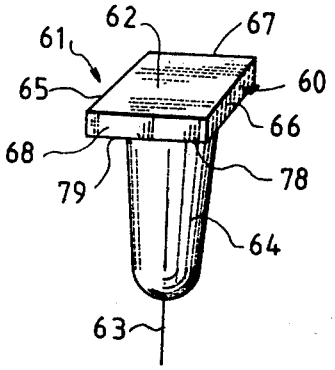
FIG. 8 is a perspective view of a plunger for another embodiment; p
Figure 9:
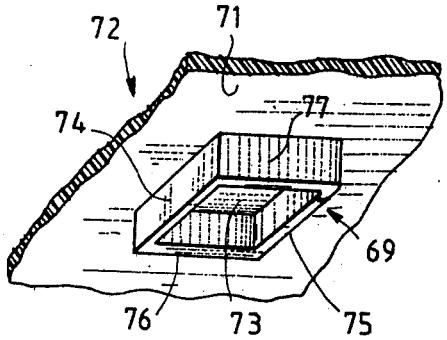
FIG. 9 is a perspective view of a cover bottom adapted to cooperate with the plunger of FIG. 8.

In the embodiment shown in FIG. 8, base 60 of plunger 61 is of square configuration. It comprises an outer face 62 perpendicular to longitudinal axis 63 of the plunger body 64, and side faces 65, 66, 67, 68. Base is adapted to mate with the rib 69, of plug 72 as seen in FIG. 9. Rib 69 projects from the inner face 71 of plug 72 and defines a housing 73, of square transverse cross-section, and faces 74, 75, 76, 77. The connection between plunger 61 and plug 72 is provided by folding back the edge of rib 69 against shoulder 78, provided by the face 79 of base 60, parallel to face 62.

Figure 10:
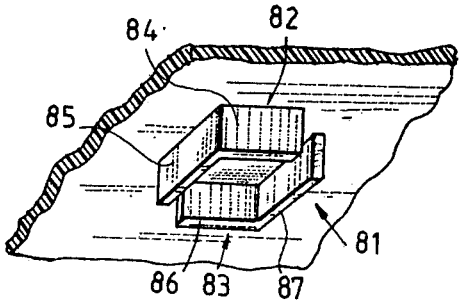
FIG. 10 is a perspective view similar to FIG. 9, but of another embodiment.

In the alternative embodiment shown in FIG. 10, rib 81 on the bottom of the plug comprises two portions 82 and 83, each formed by a dihedron, respectively 84, 85 and 86, 87. The folding back of the constituent walls of the dihedrons is thereby made easier.

Figure 11:
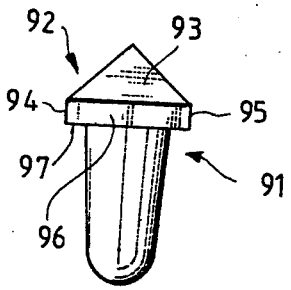
FIG. 11 is a perspective view of a plunger, for still another embodiment.
Figure 12:
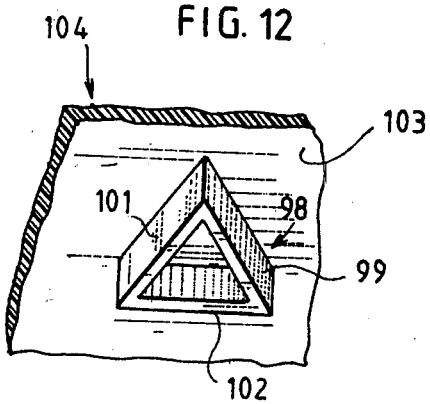
FIG. 12 is a perspective view of a bottom portion of a cover adapted to cooperate with the plunger shown in FIG. 11.

In the embodiment shown in FIG. 11, the plunger 91 has a base 92 of triangular configuration, bounded by an outer face 93 and three side faces, respectively 94, 95 and 96. A shoulder is provided at the periphery of face 97 parallel to face 93. Base 92 is adopted to mate with a cooperating rib in the shape of a prismatic sheath 98 on plug bottom 104 as seen in FIG. 12. Sheath 98 comprises three faces 99, 101, 102 perpendicular to the inner face 103 of the plug bottom 104.

Figure 13:
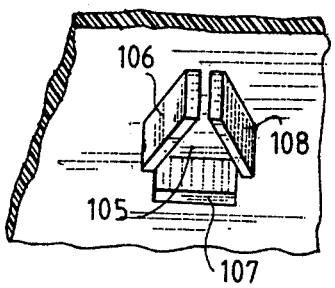
FIG. 13 is a perspective view similar to FIG. 12, but for a variation on the device of FIG. 12.

In the alternative embodiment shown in FIG. 13, the plug comprises a housing or shaft 105, of triangular configuration, adapted to cooperate with the plunger 91 of FIG. 11. Housing 105 is bounded by three tongues 106, 107 and 108 depending from the plug bottom of the plug but not connected to each other.

I claim:

1. A plugging device for a bottle, such as a scent bottle, wherein said bottle has a neck and an opening in said neck, wherein said device comprises:

(a) a plug including:
  (i) a bottom portion; and
  (ii) a rib on said bottom portion having an edge; and
(b) a plunger including:
  (i) a body;
  (ii) a base, wider than said body; and
  (iii) a shoulder connecting said body and base, wherein said plunger is adapted to be rigidly connected to said plug bottom and is adapted to mate with said opening in said neck of said bottle, and wherein said plunger is made of a material different from that of said plug bottom, and wherein said base is adapted to cooperate with said rib of said plug bottom, and wherein said edge of said rib is adapted to be folded back against said shoulder, thereby forming a rigid connection therewith.

2. The device defined by claim 1, wherein said rib is made of a thermo-plastic material.

3. The device defined by claim 2, wherein said material is nylon.

4. The device defined by claim 1, wherein said rib is thin.

5. The device defined by claim 1, wherein said plunger is made of polypropylene.

6. The device defined by claim 1, wherein said rib is circular and said base is cylindrical.

7. The device defined by claim 6, wherein said rib has the configuration of a circle.

8. The device defined by claim 6, wherein said rib has the configuration of a plurality of arcs of a circle.

9. The device defined by claim 1, wherein said rib is prismatic.

10. The device defined by claim 9 wherein said rib has a plurality of faces and said rib has at least one face that is not connected to the other faces of said rib.

11. The device defined by claim 2, wherein said rib has a square cross section.

12. The device defined by claim 11, wherein said rib comprises two generally L-shaped walls, each L-shaped wall having first and second faces generally perpendicular to each other, wherein each face on one L-shaped wall is disposed opposite from a face on said other L-shaped wall, and wherein one L-shaped wall is not connected to the other L-shaped wall.

13. The device defined by claim 9, wherein said prismatic rib is triangular.

14. The device defined by claim 13, wherein said rib comprises walls comprising tongues connected to the plug bottom, but are not connected to each other.

15. The device defined by claim 2 wherein said material is cellulose acetate.

16. A plugging device for plugging an opening in the neck of a bottle, comprising:

(a) a plug comprising a rib; and
(b) a plunger, adapted to mate with said opening at one end thereof, comprising a shoulder at the other end thereof, wherein said plunger is made of a material different from that of said rib, and wherein said rib comprises a means for rigidly connecting said plug to said plunger in response to heat being applied to said rib.

17. The device defined by claim 16 wherein said plug further comprises a bottom portion from which said rib extends and wherein said plunger comprises a body and a base, wherein said shoulder connects said body and base and wherein said edge of said rib is adapted to be folded back against said shoulder, when heat is applied thereto, to form a rigid connection between said plug and plunger.

18. The device defined by claim 17 wherein said rib is made of thermo-plastic material.

19. The device defined by claim 18 wherein said material is nylon.

20. The device defined by claim 18 wherein said material is cellulose acetate.

21. The device defined by claim 17 wherein said rib is circular and said base is cylindrical.

22. The device defined by claim 17 wherein said rib is adapted to house said base.

23. The device defined by claim 17 wherein said rib has the configuration of a plurality of arcs of a circle.

24. The device defined by claim 17 wherein said rib is a prism.

25. The device defined by claim 24 wherein said rib has a square cross-section.

26. The device defined by claim 25 wherein said rib comprises two generally L-shaped walls, wherein said two generally L-shaped walls are not connected to each other.

27. The device defined by claim 24 wherein said rib has walls comprising tongues connected to said bottom portion of said plug but not connected to each other.

* * * * *